US010384243B2

(12) United States Patent
Wang

(10) Patent No.: US 10,384,243 B2
(45) Date of Patent: Aug. 20, 2019

(54) AIR REPLENISHING FUME HOOD

(71) Applicant: L.B.T. (NanTong) Laboratory Systems Engineering Co., Ltd., Nantong, Jiangsu Province (CN)

(72) Inventor: Chu-Ping Wang, Kaohsiung (TW)

(73) Assignee: L.B.T. (NanTong) Laboratory Systems Engineering Co., Ltd., Jiangsu Province (CN)

( * ) Notice: Subject to any disclaimer, the term of this patent is extended or adjusted under 35 U.S.C. 154(b) by 154 days.

(21) Appl. No.: 15/459,038

(22) Filed: Mar. 15, 2017

(65) Prior Publication Data

US 2018/0264529 A1 Sep. 20, 2018

(51) Int. Cl.

*B08B 15/02* (2006.01)
*B01L 1/04* (2006.01)
*A62B 11/00* (2006.01)

(52) U.S. Cl.

CPC ..... *B08B 15/023* (2013.01); *B01L 1/04* (2013.01); *A62B 11/00* (2013.01); *B01L 2200/085* (2013.01); *B01L 2200/147* (2013.01)

(58) Field of Classification Search

CPC ..... B08B 15/023; A62C 2/16
USPC ... 454/49, 56, 57, 58, 59, 60, 63, 64, 65, 67
See application file for complete search history.

(56) References Cited

U.S. PATENT DOCUMENTS 3,000,292 A * 9/1961 Wojan ..... B08B 15/023 454/59
3,318,227 A * 5/1967 Nelson ..... B08B 15/023 454/59
3,340,788 A * 9/1967 Landingham ..... B08B 15/023 454/59
3,747,505 A * 7/1973 Turko ..... B08B 15/023 454/59
3,897,721 A * 8/1975 Fuhst ..... B08B 15/023 454/59
4,031,819 A * 6/1977 Applewhite ..... B08B 15/02 266/158
4,098,174 A * 7/1978 Landy ..... B08B 15/023 454/57
4,177,718 A * 12/1979 Grow ..... B08B 15/023 422/567
4,230,471 A * 10/1980 Levecque ..... C03B 37/06 264/12
4,534,281 A * 8/1985 Parks ..... B08B 15/023 454/59

(Continued)

*Primary Examiner* — Steven B McAllister
*Assistant Examiner* — Samantha A Probst
(74) *Attorney, Agent, or Firm* — Alan D. Kamrath; Mayer & Williams PC

(57) ABSTRACT

An air replenishing fume hood includes a cabinet, a door set, an air replenishing unit and an air guiding unit. The cabinet has an inner casing defining an operating chamber and having an air inlet and an air outlet. A side of the cabinet includes an operation window. A first air passage is formed between the inner casing and the cabinet. The door set includes an outer door leaf adapted to open or close the operation window, and an inner door leaf adapted to open or close the air inlet. An end of the air replenishing unit extends into an external space via an outdoor tube, and another end of the air replenishing unit is connected to the first air passage via an extension tube. The air guiding unit includes an end connected to the air outlet, and another end extending into the external space or a collection tank.

13 Claims, 6 Drawing Sheets

(56) References Cited

U.S. PATENT DOCUMENTS 4,553,475 A * 11/1985 Saunders ..... B08B 15/023 454/57
4,617,805 A * 10/1986 Ikemura ..... E06B 7/10 165/53
5,092,227 A * 3/1992 Ahmed ..... B08B 15/023 454/340
5,117,746 A * 6/1992 Sharp ..... F24C 15/2021 454/61
5,251,608 A * 10/1993 Cote ..... F24C 15/2028 126/299 D
5,338,248 A * 8/1994 Sumrack ..... B08B 15/023 204/270
5,347,754 A * 9/1994 Jacob ..... B08B 15/023 454/61
5,470,275 A * 11/1995 Jacob ..... B08B 15/023 454/59
5,718,626 A * 2/1998 Rindoks ..... B08B 15/023 454/56
5,882,254 A * 3/1999 Jacob ..... B08B 15/023 454/61
6,089,970 A * 7/2000 Feustel ..... B08B 15/023 454/57
6,428,408 B1 * 8/2002 Bell ..... B01L 1/50 454/56
6,814,658 B1 * 11/2004 Rindoks ..... E05D 13/14 454/56
7,318,771 B2 * 1/2008 Huang ..... B08B 15/023 454/61
9,248,481 B1 * 2/2016 Soto ..... B09B 5/00
2003/0027513 A1 * 2/2003 Bastian ..... B08B 15/023 454/56
2006/0079164 A1 * 4/2006 DeCastro ..... B01L 1/04 454/56
2006/0154590 A1 * 7/2006 Kanaya ..... F24F 7/06 454/56
2007/0042696 A1 * 2/2007 Casey ..... B08B 15/00 454/49
2007/0087677 A1 * 4/2007 Morris ..... B08B 15/023 454/61
2008/0108290 A1 * 5/2008 Zeigler ..... B08B 15/023 454/56
2008/0146133 A1 * 6/2008 Behrens ..... F24C 15/20 454/49
2009/0032011 A1 * 2/2009 Livchak ..... F24C 15/20 126/299 D
2009/0191803 A1 * 7/2009 Barrette ..... B08B 15/02 454/56
2011/0117828 A1 * 5/2011 Huang ..... B01L 1/50 454/65
2012/0276830 A1 * 11/2012 Huang ..... F24F 9/00 454/49
2012/0322353 A1 * 12/2012 Christopherson ..... F24F 7/00 454/56
2013/0074261 A1 * 3/2013 Hallman ..... A61G 13/0027 5/600
2013/0090049 A1 * 4/2013 Meisenzahl ..... B08B 15/023 454/56
2013/0149947 A1 * 6/2013 Bagwell ..... F24C 15/20 454/49
2014/0080396 A1 * 3/2014 Charles ..... B08B 15/023 454/61
2014/0092239 A1 * 4/2014 Pelczynski ..... B08B 15/023 348/135
2014/0211411 A1 * 7/2014 Slaby ..... H05K 7/20745 361/679.46
2015/0079890 A1 * 3/2015 Stutzman ..... B01D 46/10 454/49
2015/0368961 A1 * 12/2015 Horn ..... E06B 7/10 454/211
2017/0354998 A1 * 12/2017 Smith ..... B08B 15/023
2017/0361365 A1 * 12/2017 Singh ..... B08B 15/023

* cited by examiner

AIR REPLENISHING FUME HOOD

BACKGROUND OF THE INVENTION

1. Field of the Invention

The present invention generally relates to a fume hood used in a chemical operational chamber and, more particularly, to a fume hood capable of replenishing the operating space thereof with outdoor air to prevent directly pumping air from the airtight air-conditioned chamber, which will result in insufficient air conditioning in the air-conditioned chamber and in waste of energy.

2. Description of the Related Art

During working in the laboratory, there is often a need to carry out chemical preparation operations and microbiological experiments. Since the above processes are likely to produce harmful substances, it has been an important goal for the industry to prevent harmful substances from being exposed to the air and causing environmental pollution, as well as to avoid the operator from accidentally inhaling the harmful substances.

FIG. 1 shows a conventional fume hood 9 arranged in an airtight chamber with an air conditioning apparatus 90. The fume hood 9 has an operating chamber A inside. The operating chamber A includes an operating platform 91 for carrying out chemical preparation operations and microbiological experiments. An operation window 92 is arranged on a surface of the fume hood 9, and a door leaf 93 is slidably coupled to a body of the fume hood 9 for adjusting the operation window 92 to a predetermined opening. The fume hood 9 further has an air guide plate 94 delimiting an exhaust passage 95 in the operating chamber A. The exhaust passage 95 is connected with an air outlet 96 which can discharge harmful gas out of the fume hood 9.

Normally, a large number of the conventional fume hoods 9 are arranged in the airtight chamber with the air conditioning apparatus 90. Therefore, when the fume hood 9 is operated, the operating chamber A is continuously replenished with cooling air produced by the air conditioning apparatus 90 in the case where the harmful gas within the fume hood 9 is continuously discharged. Thus, the internal pressure of the operating chamber A is maintained.

The above conventional fume hood 9 adapts a replenishment type discharge. That is, the door leaf 93 of the operation window 92 is opened to allow the operating chamber A of the fume hood 9 to be filled with replenishing air from the air replenishment power system of the building. In such design, the air replenishment process will lead to energy consumption of the air conditioning apparatus 90, and the replenishing air cannot establish a stable air flow pattern in the operating chamber A of the fume hood 9. As a result, air turbulence and vortex problems in the operating chamber A remain unresolved, and the risk of overflow from the operating chamber A that may endanger the health and safety of experimentalists still exists. Besides, higher energy consumption can be expected if multiple fume hoods 9 are operated simultaneously.

SUMMARY OF THE INVENTION

It is therefore the objective of this invention, to provide an air replenishing fume hood comprising an air replenishing unit with an outdoor tube extending into an external space. Through the arrangement of the outdoor tube, the air replenishing fume hood will not pump air from an airtight air-conditioned chamber during operation, such that the temperature inside the air-conditioned chamber can be maintained to avoid fluctuation, achieving an energy saving effect.

In an embodiment of the invention, an air replenishing fume hood is disclosed. The air replenishing fume hood includes a cabinet, a door set, an air replenishing unit and an air guiding unit. The cabinet has an inner casing defining an operating chamber. The inner casing includes an air inlet and an air outlet. A surface of the cabinet facing the air inlet includes an operation window. A first air passage is formed between the inner casing with the air inlet and the cabinet with the operation window. The door set includes an outer door leaf and an inner door leaf. The outer door leaf is used to open or close the operation window, and the inner door leaf is used to open or close the air inlet of the inner casing. An end of the air replenishing unit extends into an external space via an outdoor tube, and another end of the air replenishing unit is connected to the first air passage via an extension tube. An end of the air guiding unit is connected to the air outlet of the inner casing, and another end of the air guiding unit extends into the external space or a collection tank.

In accordance to the above structure, since the air replenishing fume hood according to the embodiment of the invention comprises the door set with an outer door leaf and an inner door leaf that form a first air passage therebetween, and since an outdoor tube of an air replenishing unit is utilized to guide outdoor air into the first air passage, the air replenishing fume hood can ensure that the air guided into the first air passage comes from an external space during operation. Namely, the air replenishing fume hood will not pump air from an airtight air-conditioned chamber, such that the temperature inside the air-conditioned chamber can be maintained at a constant value, achieving an energy saving effect.

In an example, a guiding plate is mounted in the inner casing. A second air passage is formed between the guiding plate and the inner casing, and the second air passage intercommunicates with the air outlet of the inner casing. Thus, air in the operating chamber can exhaust more authentically.

In the example, the cabinet has a central processing unit. A spraying member and a temperature sensing device are mounted in the inner casing. The temperature sensing device is able to send a signal to the central processing unit to generate a warning signal or sound and activate the spraying member. As such, when an abnormal situation such as a fire occurs in the operating chamber, the abnormal situation can be eliminated effectively.

In the example, the central processing unit is able to control a driving device to activate the outer door leaf and the inner door leaf to close the operation window and the air inlet. As such, when an abnormal situation such as a fire occurs in the operating chamber, the spread of the abnormal situation can be prevented.

In the example, the inner door leaf includes a slot intercommunicating with the first air passage and the operating chamber. As such, a small amount of the air guided into the first air passage can be filled into the operating chamber via the slot and, thus, an air vortex that may form at the top of the operating chamber can be effectively prevented.

In the example, the door set includes two counterweights respectively connected to the outer door leaf and the inner door leaf via two connecting members. The cabinet has two motion sensors respectively sensing the displacements of the two counterweights. As such, the two motion sensors are able to send the sensing results to the central processing unit, making lifting of the outer door leaf and the inner door leaf easier, as well as enabling the central processing unit to precisely control the displacements of the outer door leaf and the inner door leaf. Thus, an air replenishment volume and an air exhaust volume can be adjusted precisely.

In the example, each connecting member is coupled to a transmission assembly and driven to rotate by the driving device, making it easier to control lifting the outer door leaf and the inner door leaf.

In the example, the door set further includes a control switch. The control switch is a multistage footswitch, and the control switch is able to control the outer door leaf and the inner door leaf to be fully opened or partially opened at the same time, making it easier for the operator to control lifting of the outer door leaf and the inner door leaf.

In the example, the door set further includes a manual button, and the manual button is able to control the movement of the inner door leaf, making it easier for the operator to control lifting of the outer door leaf and the inner door leaf.

In the example, the door set includes a region sensor able to generate and send a signal to the central processing unit when an operator leaves the air replenishing fume hood. The central processing unit activates the driving device to drive the outer door leaf and the inner door leaf after receiving the signal. As such, when the operator leaves the air replenishing fume hood, the outer door leaf and the inner door leaf are closed to a predetermined height automatically, assuring that air inside the air replenishing fume hood does not overflow.

In the example, the air replenishing unit includes an intake valve having an opening angle, and the opening angle is able to be changed to control an air replenishment volume. As such, the air replenishment volume can be adjusted precisely.

In the example, the air replenishing unit includes a first air volume detecting device mounted in the first air passage or the extension tube. As such, the air replenishment volume can be adjusted precisely.

In the example, the air guiding unit includes an exhaust valve having an opening angle, and the opening angle is able to be changed to control an air exhaust volume. As such, the air replenishment volume of the first air passage and the air exhaust volume of the operating chamber can be adjusted precisely to keep the air exhaust volume larger than the air replenishment volume.

In the example, the air guiding unit includes an air expelling device such as an exhaust fan. As such, the air exhaust volume can be adjusted precisely.

In the example, the air replenishing unit includes an air inhaling device such as a blower. As such, the air replenishment volume of the first air passage and the air exhaust volume of the operating chamber can be adjusted precisely to keep the air exhaust volume larger than the air replenishment volume.

In the example, the air guiding unit further includes a second air volume detecting device mounted in the inner casing. As such, the air exhaust volume can be adjusted precisely.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
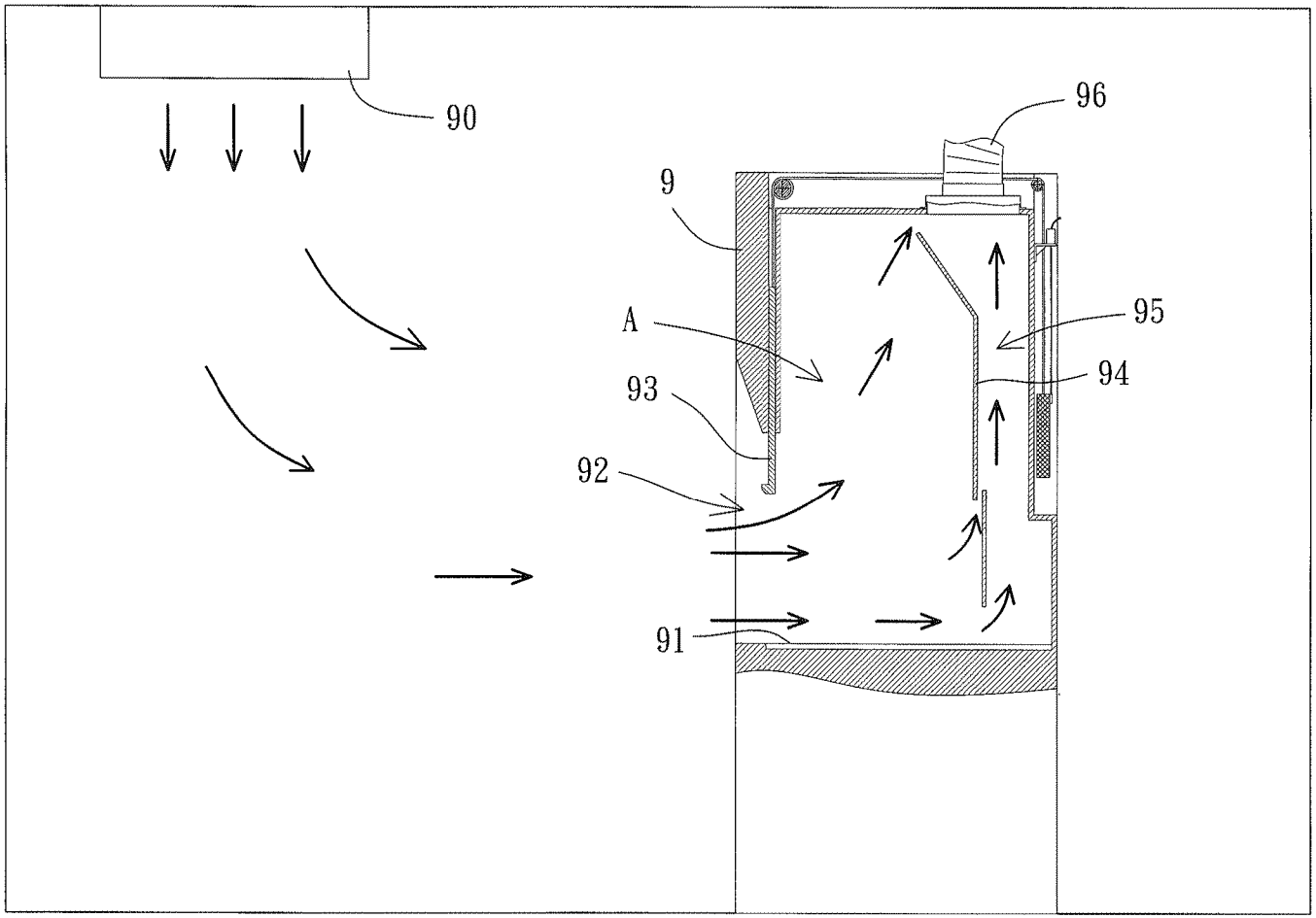
FIG. 1 PRIOR ART
FIG. 1 is a cross-sectional view of a conventional fume hood.

In the various figures of the drawings, the same numerals designate the same or similar parts. Furthermore, when the terms "top", "bottom", "inner", "outer" and similar terms are used hereinafter, it should be understood that these terms have reference only to the structure shown in the drawings as it would appear to a person viewing the drawings, and are utilized only to facilitate describing the invention.

DETAILED DESCRIPTION OF THE INVENTION

In the following contents, the term "external space" may be an outside space isolated from a space inside a building, an airtight space, an airtight chamber with an air conditioning apparatus, or the conventional operational chamber.

Figure 2:
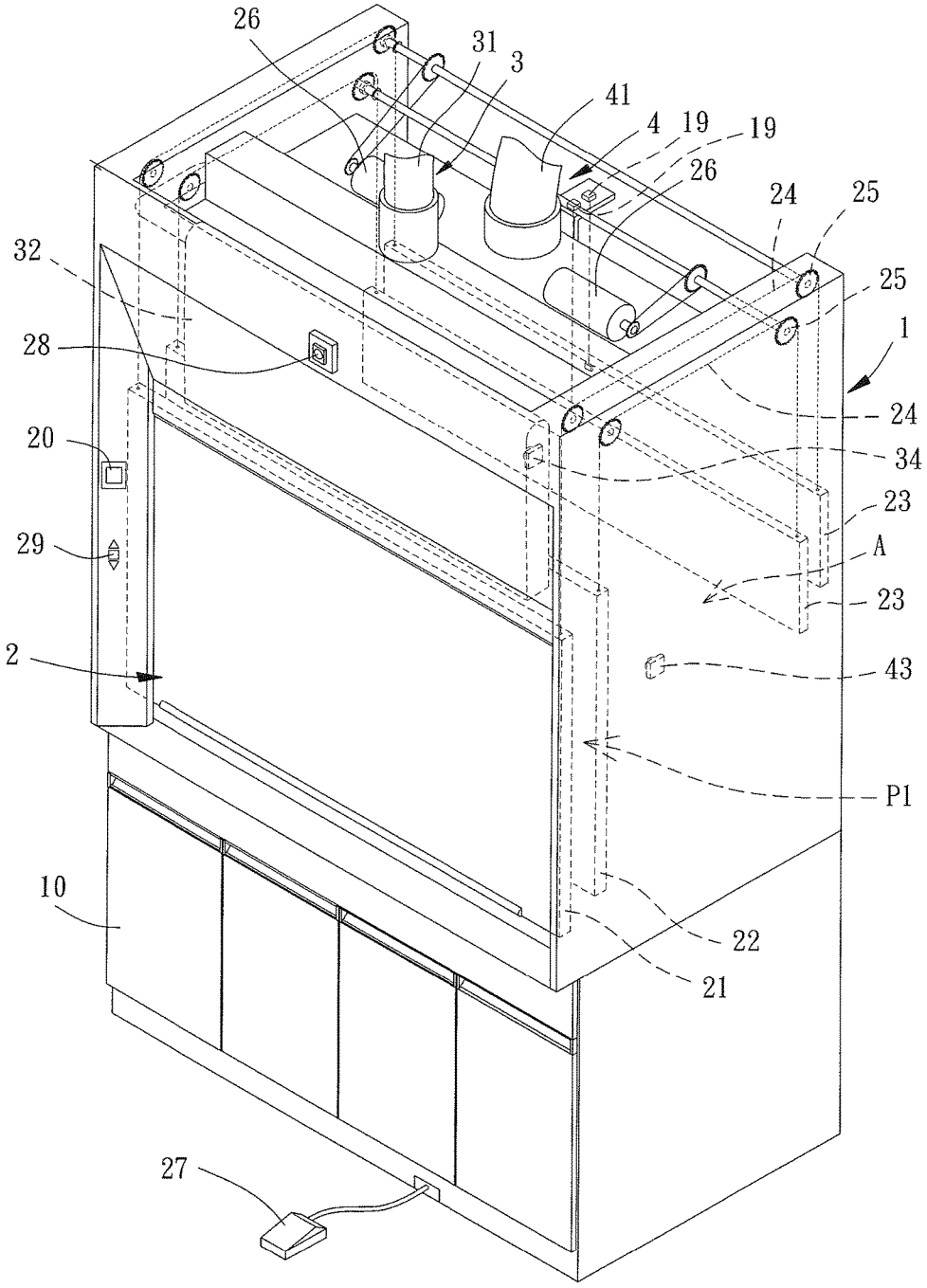
FIG. 2 is a perspective view of an air replenishing fume hood according to an embodiment of the invention.
Figure 3:
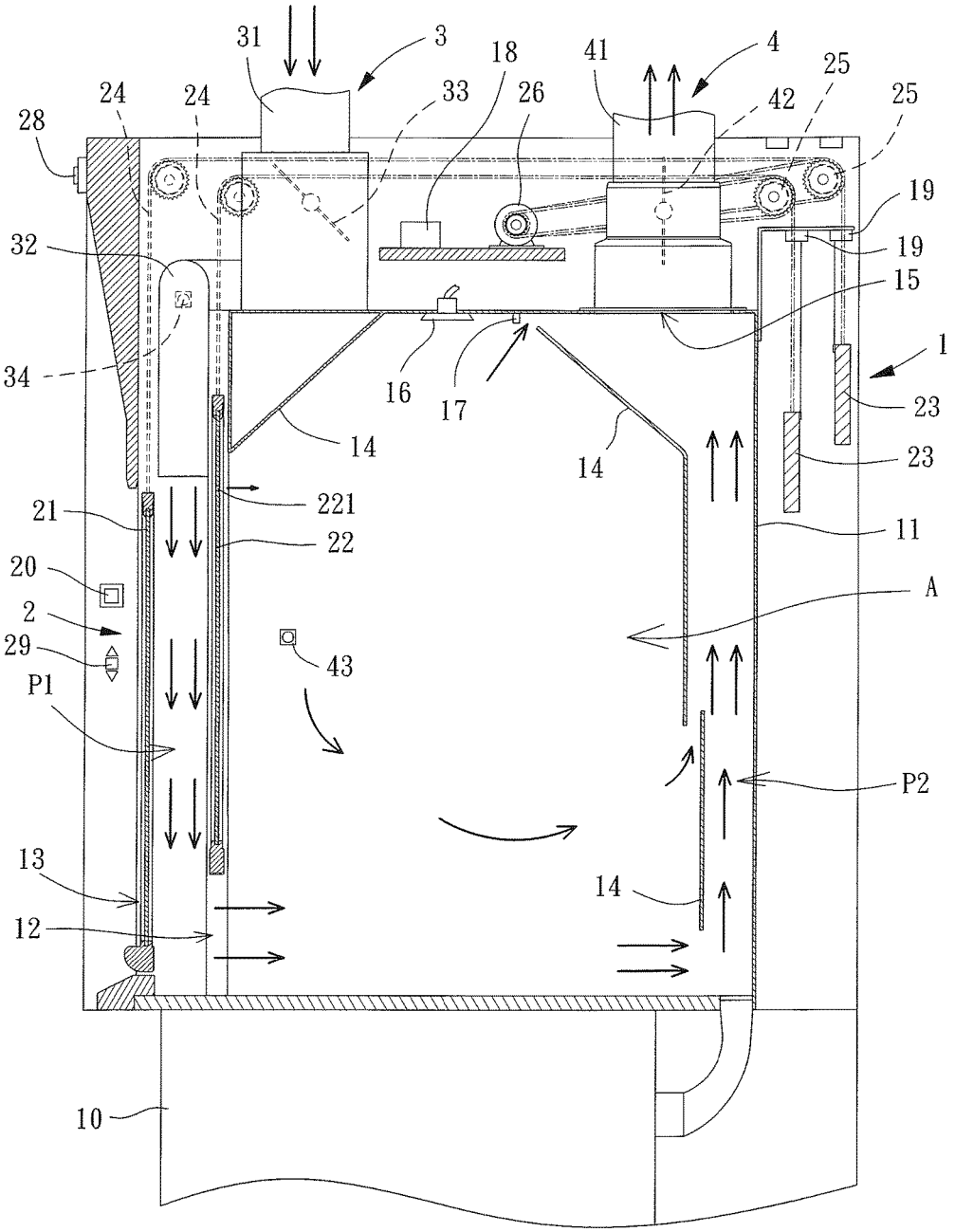
FIG. 3 is a cross-sectional view of the air replenishing fume hood according to the embodiment of the invention.

FIGS. 2 and 3 shows an air replenishing fume hood according to an embodiment of the invention. The air replenishing fume hood comprises a cabinet 1 provided with a door set 2, an air replenishing unit 3 and an air guiding unit 4. The cabinet 1 defines an internal space. The door set 2 is coupled to a side of the cabinet 1 and has an inner door leaf 22 separating the cabinet 1 into an operating chamber A and a first air passage P1. The air replenishing unit 3 may guide outdoor air into the first air passage P1 and the operating chamber A. The air guiding unit 4 may guide air from the operating chamber A to an external space via a second air passage P2.

The cabinet 1 may be in the form of a cuboid and arranged on a base 10. The cabinet 1 has an inner casing 11 defining the operating chamber A. The inner casing 11 includes an air inlet 12. The side of the cabinet 1 facing the air inlet 12 includes an operation window 13. The operation window 13 may be opened or closed by an outer door leaf 21 of the door set 2, and the air inlet 12 may be opened or closed by the inner door leaf 22. The first air passage P1 is formed between the inner casing 11 with the air inlet 12 and the cabinet 1 with the operation window 13. The first air passage P1 intercommunicates with the air replenishing unit 3, allowing outdoor air to be guided into the inner casing 11 via the air inlet 12. The inner casing 11 can further receive a guiding plate 14 to avoid the formation of a dead angle. By providing the guiding plate 14, airflow can be smoothly guided to avoid the air turbulence, and the second air passage P2 can be formed inside the inner casing 11, such that the air in the operating chamber A may be guided to the air guiding unit 4 via the second air passage P2.

The inner casing 11 further includes an air outlet 15 through which the air in the operating chamber A may be guided outwards to the air guiding unit 4. The second air passage P2 intercommunicates with the air outlet 15 of the inner casing 11. The inner casing 11 can further receive a spraying member 16. The spraying member 16 may be connected to a fire extinguishing material (not shown) and can be coupled to a temperature sensing device 17. When an abnormal situation such as a fire occurs in the operating chamber A, the temperature sensing device 17 may generate a warning signal or sound to activate the outer door leaf 21 and the inner door leaf 22 of the door set 2 to close the operation window 13 and the air inlet 12, and to control the spraying member 16 to spay the fire extinguishing material. A central processing unit 18 is coupled to a top portion of the cabinet 1. The central processing unit 18 can receive signals sent by the temperature sensing device 17, a detection device or a control device and can perform corresponding actions. The top portion of the cabinet 1 may be unsealed, such that the door set 2 can be easily installed or maintained.

Figure 4:
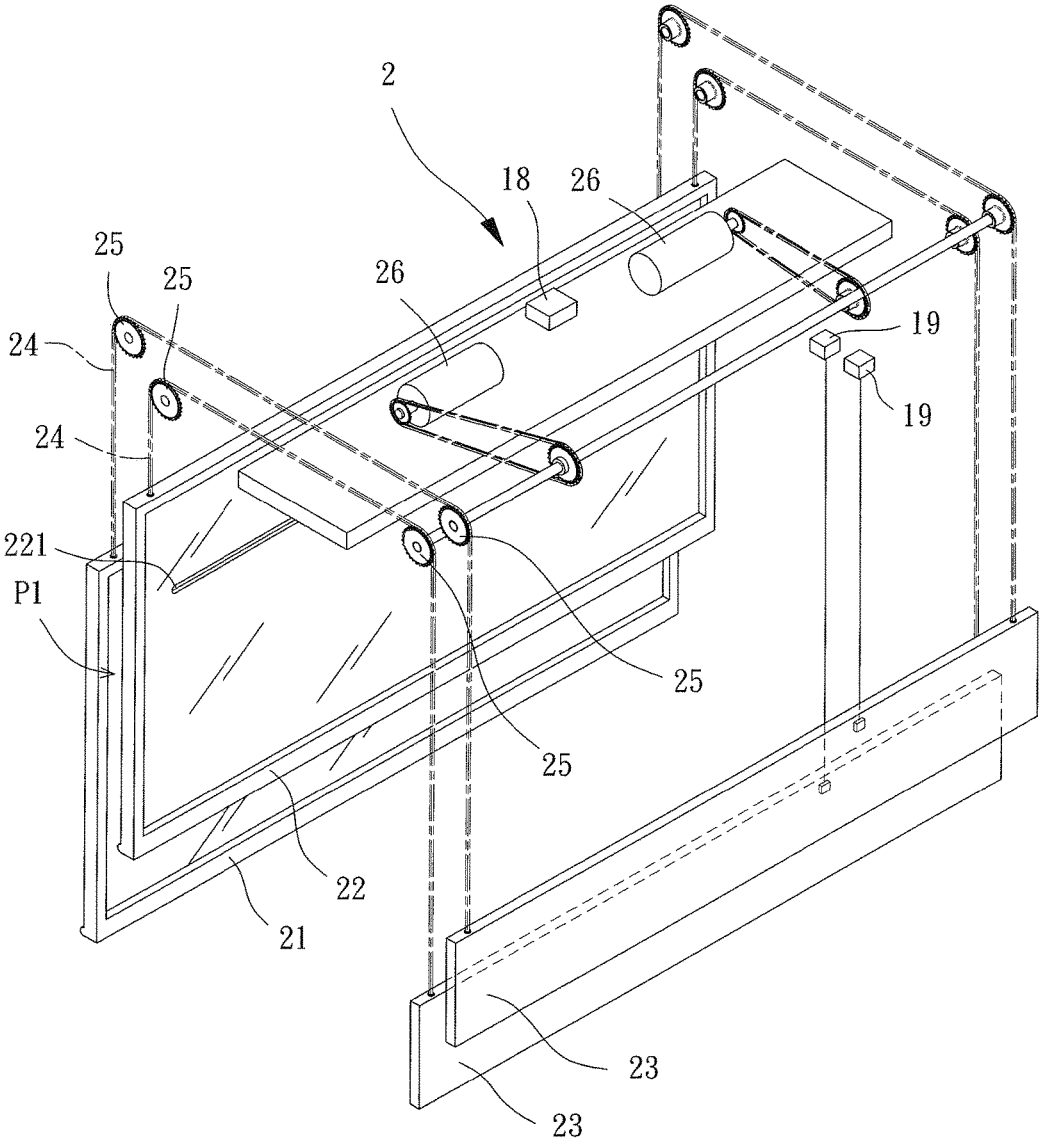
FIG. 4 is a perspective view of a door set of the air replenishing fume hood according to the embodiment of the invention.

Referring to FIGS. 2, 3 and 4, the door set 2 includes the outer door leaf 21 and the inner door leaf 22. The outer door leaf 21 may be used to open or close the operation window 13, and the inner door leaf 22 may be used to open or close the air inlet 12. The outer and inner door leafs 21, 22 may be made of transparent materials such as explosion-proof glass. The inner door leaf 22 may include a slot 221 (which may also be a plurality of air vents). The slot 221 intercommunicates with the first air passage P1 and the operating chamber A, such that a small amount of the air guided into the first air passage P1 can be filled into the inner case 11 via the slot 221. By such an arrangement, an air vortex that may be formed at the top of the operating chamber A can be effectively prevented. In order to make lifting of the outer door leaf 21 and the inner door leaf 22 easier, the door set 2 can include two counterweights 23 respectively connected to the outer door leaf 21 and the inner door leaf 22 via a respective connecting member 24 (such as a chain). Each of the connecting members 24 can also be coupled to a transmission assembly 25 and can be driven to rotate by a driving device 26 (such as a motor).

The cabinet 1 can have two motion sensors 19 electrically connected to the central processing unit 18 if necessary. The two motion sensors 19 can respectively sense the displacements of the two counterweights 23, such that the central processing unit 18 can control the displacements of the outer door leaf 21 and the inner door leaf 22. Moreover, in order to make it easier to control lifting of the outer door leaf 21 and the inner door leaf 22, the door set 2 can also include a control switch 27, a region sensor 28, a manual button 29 and an emergency button 20. The control switch 27 may be a footswitch as shown in FIG. 2, and the control switch 27 may be a multistage switch, such that the number of times the control switch 27 is pressed can be utilized to control the outer door leaf 21 and the inner door leaf 22 to be fully opened or partially opened at the same time. The region sensor 28 can be coupled to a portion of the cabinet 1 adjacent to the operation window 13. Thus, the region sensor 28 is able to generate and send a signal to the central processing unit 18 when an operator leaves or stops operating the air replenishing fume hood, and the driving device 26 is activated by the central processing unit 18 to lower the outer door leaf 21 and the inner door leaf 22 to a predetermined height. The manual button 29 can be pressed by the operator to adjust the inner door leaf 22 to a desired height. Furthermore, when an abnormal situation such as an unusual fire occurs in the operating chamber A, by pressing the emergency button 20, the operator can rapidly lower the outer door leaf 21 and the inner door leaf 22 to close the operation window 13 and the air inlet 12, as well as control the spraying member 16 to spray the fire extinguishing material.

The air replenishing unit 3 may guide outdoor air into the first air passage P1. As shown in FIGS. 2 and 3, an end of the air replenishing unit 3 extends into the external space via an outdoor tube 31, and the other end of the air replenishing unit 3 is connected to the first air passage P1 via an extension tube 32. The air replenishing unit 3 can also include an intake valve 33 having an opening angle which can be changed to control an air replenishment volume. Besides, in order to precisely control the air in the operating chamber A in a negative pressure state, the air replenishing unit 3 may further include a first air volume detecting device 34. The first air volume detecting device 34 is received in the first air passage P1 or the extension tube 32 for detecting the air replenishment volume, that is, the volume of air guided from the outdoor tube 31 into the operating chamber A. When the first air volume detecting device 34 senses that the air replenishment volume is greater than a threshold value, it will generate and send a signal to the central processing unit 18 to reduce the opening angle of the intake valve 33. By this arrangement, the air replenishment volume of the operating chamber A is reduced and kept smaller than an air exhaust volume of the second air passage P2, assuring that air in the operating chamber A does not overflow through the air inlet 12 or the operation window 13.

The air guiding unit 4 may guide air from the operating chamber A to an external space. As shown in FIGS. 2 and 3, an end of the air guiding unit 4 is connected to the air outlet 15 of the inner casing 11, and the other end of the air guiding unit 4 extends into the external space or a collection tank via an guiding tube 41. The air guiding unit 4 can also include an exhaust valve 42 and a second air volume detecting device 43. The exhaust valve 42 has an opening angle which can be changed to control the air exhaust volume. The second air volume detecting device 43 is received in the inner casing 43 for detecting the air replenishment volume, that is, the volume of air guided from the guiding tube 41 to the external space. When the second air volume detecting device 43 senses that the air exhaust volume is smaller than a threshold value, it will generate and send a signal to the central processing unit 18 to expand the opening angle of the exhaust valve 33 and, thus, increase the air exhaust volume. If necessary, the air guiding unit 4 may include an air expelling device such as an exhaust fan, or the air replenishing unit 3 may include an air inhaling device such as a blower, such that airflow can be smoothly guided, assuring that the air replenishment volume of the operating chamber A is kept smaller than the air exhaust volume of the second air passage P2.

Figure 5:
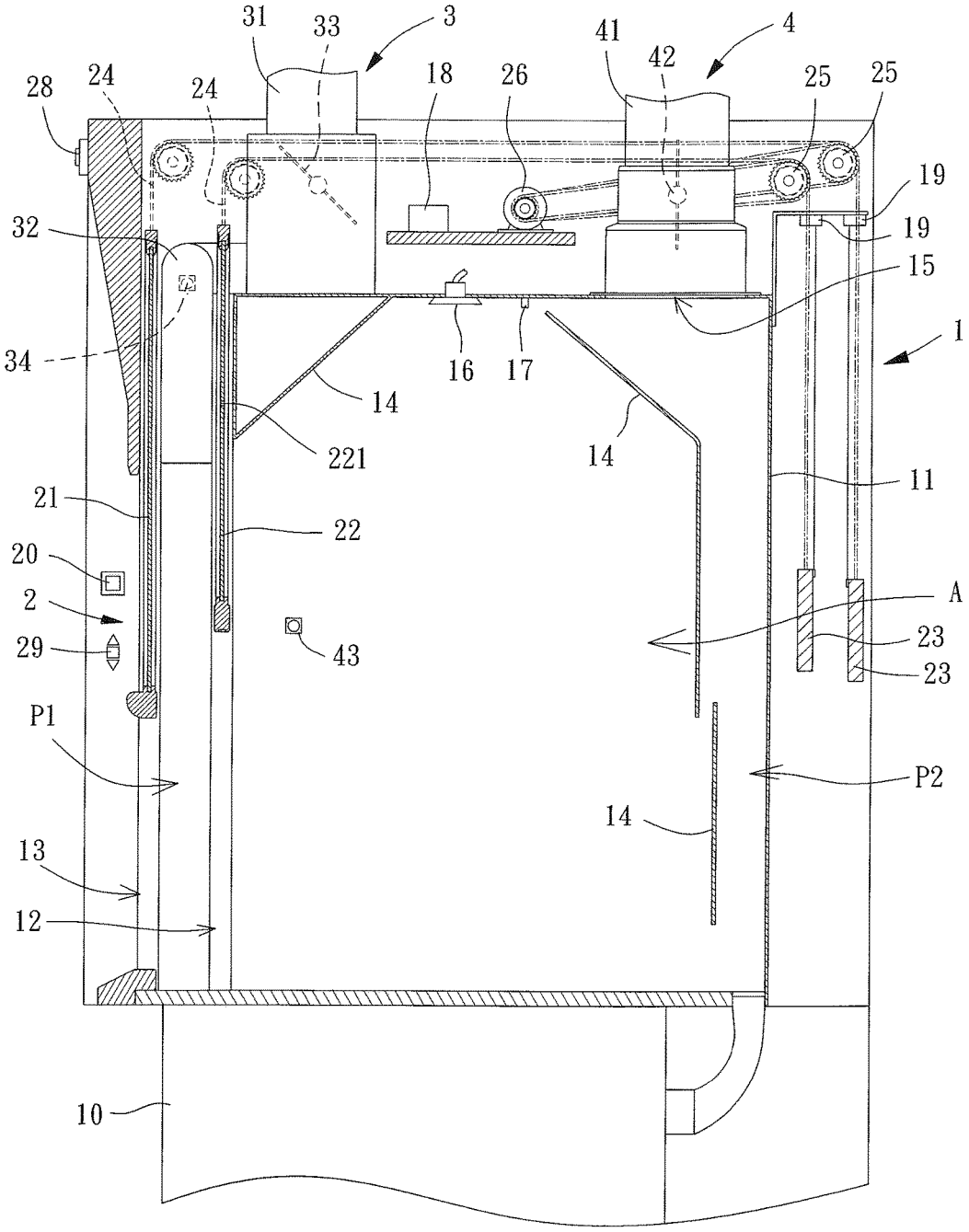
FIG. 5 is a cross-sectional view illustrating use of the air replenishing fume hood according to the embodiment of the invention.

FIG. 5 shows use of the air replenishing fume hood according to the embodiment of the invention. An operator can lift the outer door leaf 21 and the inner door leaf 22 to a desired height by manually pressing the manual button 29 or the stepping on the control switch 27. Thus, the operator can easily operate in the operating chamber A.

Figure 6:
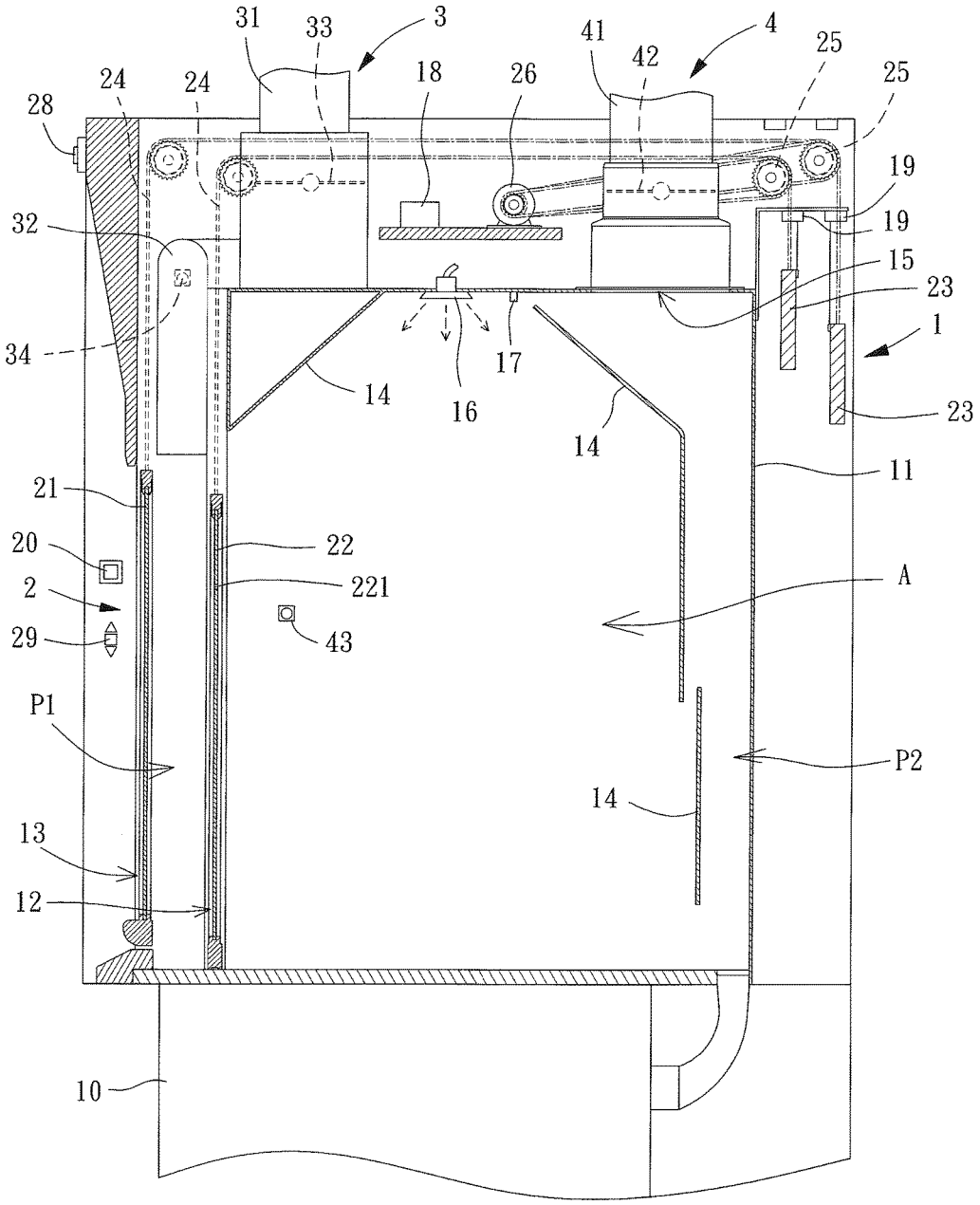
FIG. 6 is a cross-sectional view illustrating use of the air replenishing fume hood according to the embodiment of the invention when an abnormal situation occurs in an operating chamber.

FIG. 6 shows that when an abnormal situation such as a fire occurs in the operating chamber A, the temperature sensing device 17 may generate a warning signal or sound. Instead, an operator may press the emergency button 20 to activate the outer door leaf 21 and the inner door leaf 22 of the door set 2 to close the operation window 13, the air inlet 12 and the intake valve 33 of the air replenishing unit 3, as well as control the spraying member 16 to spray the fire extinguishing material, preventing the fire from spreading to the air replenishing fume hood.

In summary, since the air replenishing fume hood according to the embodiment of the invention comprises the door set 2 with an outer door leaf 21 and an inner door leaf 22 that form a first air passage P1 therebetween, and since an outdoor tube 31 of an air replenishing unit 3 is utilized to guide outdoor air into the first air passage P1, the air replenishing fume hood can ensure that the air guided into the first air passage P1 comes from an external space during operation. Namely, the air replenishing fume hood will not pump air from an airtight air-conditioned chamber, such that the temperature inside the air-conditioned chamber can be maintained at a constant value, achieving an energy saving effect.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. An air replenishing fume hood comprising:

a cabinet having an inner casing defining an operating chamber, wherein the inner casing includes an air inlet and an air outlet, wherein a surface of the cabinet facing the air inlet includes an operation window, wherein a first air passage is formed between the inner casing with the air inlet and the cabinet with the operation window;

a spraying member mounted in the inner casing;

a temperature sensing device mounted in the inner casing;

a door set including an outer door leaf, an inner door leaf, and two counterweights respectively connected to the outer door leaf and the inner door leaf via two connecting members, wherein the outer door leaf opens or closes the operation window, and wherein the inner door leaf opens or closes the air inlet of the inner casing;

an air replenishing unit, wherein an end of the air replenishing unit extends into an external space via an outdoor tube, and wherein another end of the air replenishing unit is connected to the first air passage via an extension tube; and an air guiding unit, wherein an end of the air guiding unit is connected to the air outlet of the inner casing, and wherein another end of the air guiding unit extends into the external space or a collection tank, wherein the cabinet further comprises a central processing unit and two motion sensors, wherein the two motion sensors respectively sense displacements of the two counterweights, wherein the central processing unit is configured to control a driving device to activate the outer door leaf and the inner door leaf to close the operation window and the air inlet, and wherein the temperature sensing device is configured to send a signal to the central processing unit to generate a warning signal or sound and activate the spraying member.

2. The air replenishing fume hood as claimed in claim 1, wherein a guiding plate is mounted in the inner casing, wherein a second air passage is formed between the guiding plate and the inner casing, and wherein the second air passage intercommunicates with the air outlet of the inner casing.

3. The air replenishing fume hood as claimed in claim 1, wherein the inner door leaf includes a slot intercommunicating with the first air passage and the operating chamber.

4. The air replenishing fume hood as claimed in claim 1, wherein each of the two connecting members is coupled to a transmission assembly and driven to rotate by the driving device.

5. The air replenishing fume hood as claimed in claim 1, wherein the door set further includes a control switch, wherein the control switch is a multistage footswitch, and wherein the control switch is configured to control the outer door leaf and the inner door leaf to be fully opened or partially opened at the same time.

6. The air replenishing fume hood as claimed in claim 1, wherein the door set further includes a manual button, and wherein the manual button is configured to control movement of the inner door leaf.

7. The air replenishing fume hood as claimed in claim 1, wherein the door set further includes a region sensor configured to generate and send a signal to the central processing unit when an operator leaves the air replenishing fume hood, and wherein the central processing unit activates the driving device to close the outer door leaf and the inner door leaf to a predetermined height after receiving the signal.

8. The air replenishing fume hood as claimed in claim 1, wherein the air replenishing unit includes an intake valve having an opening angle, and wherein the opening angle is adjustable to control an air replenishment volume.

9. The air replenishing fume hood as claimed in claim 1, wherein the air replenishing unit includes a first air volume detecting device mounted in the first air passage or the extension tube.

10. The air replenishing fume hood as claimed in claim 1, wherein the air guiding unit includes an exhaust valve having an opening angle, and wherein the opening angle is adjustable to control an air exhaust volume.

11. The air replenishing fume hood as claimed in claim 1, wherein the air guiding unit includes an air expelling device.

12. The air replenishing fume hood as claimed in claim 1, wherein the air replenishing unit includes an air inhaling device.

13. The air replenishing fume hood as claimed in claim 1, wherein the air guiding unit includes a second air volume detecting device mounted in the inner casing.

* * * * *